US008201915B2

(12) United States Patent
Ito

(10) Patent No.: US 8,201,915 B2
(45) Date of Patent: Jun. 19, 2012

(54) METHOD FOR EVALUATING DISCHARGE AMOUNT OF LIQUID DROPLET DISCHARGING DEVICE

(75) Inventor: Yoshihiro Ito, Shiojiri (JP)

(73) Assignee: Seiko Epson Corporation (JP)

( * ) Notice: Subject to any disclaimer, the term of this patent is extended or adjusted under 35 U.S.C. 154(b) by 401 days.

(21) Appl. No.: 12/621,733

(22) Filed: Nov. 19, 2009

(65) Prior Publication Data

US 2010/0128080 A1 May 27, 2010

(30) Foreign Application Priority Data

Nov. 21, 2008 (JP) ..... 2008-298095

(51) Int. Cl.
*B41J 29/38* (2006.01)
*B41J 29/393* (2006.01)

(52) U.S. Cl. ..... 347/19; 347/16

(58) Field of Classification Search ..... 347/6–7, 347/16, 19

See application file for complete search history.

(56) References Cited

U.S. PATENT DOCUMENTS 6,702,425 B1 * 3/2004 Yip et al. ..... 347/40
6,991,315 B2 1/2006 Nakamura et al.
7,455,389 B2 11/2008 Nakamura et al.
2007/0206039 A1 * 9/2007 Kawamura et al. ..... 347/14

FOREIGN PATENT DOCUMENTS

| | | |
|---|---|---|
| JP | 2001-041799 | 2/2001 |
| JP | 2003-159787 | 6/2003 |
| JP | 2003-254810 | 9/2003 |
| JP | 2005-119139 | 5/2005 |
| JP | 2005-246807 | 9/2005 |

* cited by examiner

*Primary Examiner* — Jason Uhlenhake
(74) *Attorney, Agent, or Firm* — Harness, Dickey & Pierce, P.L.C.

(57) ABSTRACT

A discharge amount evaluation method of a liquid droplet discharging device evaluates a discharge amount of a liquid discharged by the liquid droplet discharging device. The liquid includes at least one of a solution prepared by dissolving a solute in a solvent and a dispersion prepared by dispersing a dispersoid in a dispersion medium. The method includes discharging the liquid by the liquid droplet discharging device on a receiving layer of a test piece, the test piece including the receiving layer that absorbs at least one of the solvent and the dispersion medium as components included in the liquid and a base layer that is abutted with the receiving layer and that does not absorb the at least one component absorbed by the receiving layer in the components included in the liquid; and evaluating the discharge amount of the liquid based on a result obtained by evaluating an area of an absorbing portion where the at least one absorbed component has spread in the receiving layer.

8 Claims, 8 Drawing Sheets

METHOD FOR EVALUATING DISCHARGE AMOUNT OF LIQUID DROPLET DISCHARGING DEVICE

BACKGROUND

1. Technical Field

The present invention relates to a discharge amount evaluation method of a liquid droplet discharging device.

2. Related Art

In the recent years, much attention has been paid on film forming techniques using a liquid droplet discharging method. The liquid droplet discharging method allows a minute liquid including a film forming material to be placed in intended positions to form a minute film pattern. Thereby, patterning can be achieved more easily than in photolithography, and wasted use of the film forming material can be reduced, resulting in saving of production cost.

The liquid droplet discharging method uses a liquid droplet discharging head. For example, the liquid droplet discharging head includes a large number of discharging units placed in an X direction. Each of the discharging units includes a liquid reserving section, a nozzle, and a piezoelectric element pressurizing a liquid to push it out from the nozzle. The liquid droplet discharging head scans over a film forming surface in a Y direction to discharge the liquid from the discharging units so as to place the film forming material on the surface.

For the liquid droplet discharging head, it is necessary to discharge an equal amount of the liquid from the discharging units. If the amount of the liquid discharged varies, a film thickness in the Y direction also varies. For example, in production of a color filter for an image display apparatus or the like by the liquid droplet discharging method, a film thickness variation on the color film may be recognized as a streak along a scanning direction (a streak variation), leading to deterioration of display quality.

In order to reduce such discharge amount variation, for example, JP-A-2003-159787 discloses a technique for controlling a discharge amount of each discharging unit. The technique reduces the discharge amount variation by controlling discharging operation of discharging units that discharge an amount of a liquid droplet significantly different from a predetermined value. For application of the technique, it is extremely important to accurately know a discharge amount per discharging unit, since control of the discharge amount can be suitably accomplished by knowing a difference between the discharge amount per discharging unit and the predetermined value.

Among discharge amount evaluation methods, there is a known method for calculating a volume of a shape of a liquid discharged. In this method, first, the liquid is placed (discharged) on a testing substrate by a liquid droplet discharging head. Then, by evaporation of a liquid component included in the placed liquid, such as a solvent or a dispersion medium, there is obtained a solid made of a solid component in the liquid. Next, using an optical interference method or the like, an outline of the solid is measured on a measurement plane parallel to the testing substrate. The outline measurement is performed on a plurality of measurement planes obtained by changing a distance between the testing substrate and the measurement plane.

On each of the measurement planes, an area surrounded by the outline of the solid is calculated to obtain a cross-sectional area of the solid on the each measurement plane. Thereby, there can be obtained a cross-sectional area of the solid with respect to a distance from a bottom to a top (a height) of the solid, and then, the obtained cross-sectional area is integrated by the height to obtain a volume of the solid. Since a composition of the liquid discharged is known, a volume of the liquid can be reversely calculated from the volume of the solid, so that the discharge amount can be evaluated.

However, the above evaluation method cannot evaluate the discharge amount with high precision and high efficiency because of following reasons.

In the evaluation method, the outline measurement is performed after drying the liquid. For example, if the method requires a drying time of approximately eight hours, efficient measurement is impossible. In order to reduce the drying time, heating processing or the like may be considered. However, such processing may cause, for example, an increase of an additional step and reduction in evaluation precision due to deterioration or the like in quality of the liquid caused by heating.

Furthermore, in order to improve the evaluation precision of the evaluation method, it is conceivable to increase measurement precision of a three-dimensional shape of the solid. For example, multiple-point measurements can be performed by variously changing the distance between the testing substrate and the measurement plane. In this case, however, in each measurement, an optical interferometer needs to be adjusted for each measurement plane to pickup an image of the solid. As a result, it takes a large amount of work and time to perform the multiple-point measurements, thereby making the measurements inefficient.

SUMMARY

The present invention has been accomplished in view of the circumstances. An advantage of the invention is to provide a method for evaluating discharge amounts of a liquid droplet discharging device. The method evaluates the discharge amounts with high precision and high efficiency.

According to a first aspect of the invention, there is provided a discharge amount evaluation method of a liquid droplet discharging device that is performed to evaluate a discharge amount of a liquid discharged by the liquid droplet discharging device. The liquid includes at least one of a solution prepared by dissolving a solute in a solvent and a dispersion prepared by dispersing a dispersoid in a dispersion medium. The discharge amount evaluation method includes discharging the liquid by the liquid droplet discharging device on a receiving layer of a test piece, the test piece including the receiving layer that absorbs at least one of the solvent and the dispersion medium as components included in the liquid and a base layer that is abutted with the receiving layer and that does not absorb the at least one component absorbed by the receiving layer in the components included in the liquid; and evaluating the discharge amount of the liquid based on a result obtained by evaluating an area of an absorbing portion where the at least one absorbed component has spread in the receiving layer.

When the liquid is discharged on the receiving layer of the test piece by the liquid droplet discharging device, the at least one absorbed component of the liquid is absorbed by the receiving layer but not absorbed by the base layer abutted with the receiving layer and spreads in a planar direction of the receiving layer. Accordingly, a volume of the at least one absorbed component is equivalent to a product of the area of the absorbing portion in the receiving layer where the at least one absorbed component has spread and a thickness of the receiving layer, resulting in an amount in proportion to the area of the absorbing portion. In addition, the volume of the at least one absorbed component is determined by a composition and a volume of the liquid discharged and is an amount in proportion to the volume of the liquid, so that the area of the absorbing portion results in an amount proportional to the volume of the discharged liquid. Thus, the volume of the discharged liquid can be obtained from the area of the absorbing portion, and relative volume comparison of the liquid can be made based on the area of the absorbing portion, thereby achieving evaluation of the discharge amount of the liquid.

The discharge amount evaluation method of a liquid droplet discharging device as above does not require drying of the discharged liquid. Accordingly, no drying time is needed and thus the discharge amount can be efficiently evaluated. Additionally, the discharge amount is evaluated using the area, which is an amount that can be evaluated by two-dimensional measurement. This can greatly simplify a measurement process, as compared to shape measurement by three-dimensional measurement, thereby achieving efficient evaluation of the discharge amount.

In addition, the method of the aspect can prevent reduction in evaluation precision due to a volume change in a solid obtained by drying the liquid caused depending on a degree of dryness. Furthermore, it can also be prevented that the evaluation precision is reduced due to shape distortion of the solid resulting from deterioration of the liquid in a drying process, partial unevenness in the degree of dryness of the liquid, and the like.

Therefore, the evaluation method of the aspect allows the discharge amount discharged by the liquid droplet discharging device to be evaluated with high precision and high efficiency.

Preferably, in the evaluation step, the area is evaluated by an image-pickup processing that picks up an image of the absorbing portion and an analyzing processing that analyzes the image.

In this manner, the area of the absorbing portion is evaluated based on the image picked up. Thus, as compared to evaluation of the area by visual observation, the area of even a minute absorbing portion can be evaluated with high precision and high efficiency.

Preferably, in the analyzing processing, a threshold is set using a gradation of the absorbing portion in the image and a gradation of a peripheral region around the absorbing portion in the image to detect an outline of the absorbing portion based on the threshold so as to evaluate the area of the absorbing portion.

In this manner, the outline of the absorbing portion can be objectively detected based on the threshold, whereby the area of the absorbing portion can be accurately evaluated. Additionally, the threshold is set for each absorbing portion, thereby preventing reduction in the evaluation precision due to temporal or spatial changes in illumination of light used for the image pickup.

Preferably, in the analyzing processing, the gradation of the absorbing portion is a gradation of a part except for a rim of the absorbing portion in the image, and the gradation of the peripheral region is a gradation of a part except for a region adjacent to the absorbing portion in the image.

In general, a region near an outline of an image pickup subject in a picked-up image tends to be blurred due to an optical system such as a lens used for the image pickup. However, as described above, by setting the threshold in a manner excluding the rim of the absorbing portion and the region adjacent to the absorbing portion, namely, the region near the outline of the image pickup subject, the threshold is not influenced by blurring of the outline of the absorbing portion, so that the threshold can be set to a high-precision value. Consequently, the outline of the absorbing portion can be accurately detected, achieving high-precision evaluation of the discharge amount.

Preferably, in the analyzing processing, the gradation of the absorbing portion and the gradation of the peripheral region are obtained by excluding a gradation changing region in the image.

In this manner, the blurring of the outline of the absorbing portion can be objectively excluded, so that the threshold can be set to an appropriate value. This allows accurate detection of the outline of the absorbing portion, thereby achieving high-precision evaluation of the discharge amount.

Preferably, in the evaluation step, the image pickup processing is performed a plurality of times by changing a focal distance, and in the analyzing processing, the threshold is set using a plurality of images obtained by performing the image pickup processing the plurality of times.

When the image pickup processing is performed plural times by changing the focal distance, a size of a region having a blurred outline of the absorbing portion changes in accordance with the focal distance in each of the images obtained by the plurality of times of the image pickup processing. Regardless of the size of the region having the blurred outline, a size ratio is approximately constant between portions located inside and outside an actual outline in the region with the blurred outline. Thus, the actual outline can be accurately obtained from the images.

Preferably, in the analyzing processing, the threshold is a mean value between the gradation of the absorbing portion and the gradation of the peripheral region.

The actual outline of the absorbing portion is located at an approximately center position between outer and inner peripheries of the region with the blurred outline. In the image pickup processing, as the image becomes more defocused, the blurred outline region is increased. However, as described above, the actual outline can be accurately obtained without the influence of a defocused amount in the image pickup processing.

Preferably, in the analyzing processing, a first temporary evaluation of the area is performed using a first threshold that is an integer obtained by rounding up figures after decimal point in the threshold and a second temporary evaluation of the area is performed using a second threshold that is an integer obtained by rounding down the figures after decimal point in the threshold, as well as a value evaluating the area in the first temporary evaluation is weighted in inverse proportion to a difference between the threshold and the first threshold and a value evaluating the area in the second temporary evaluation is weighted in inverse proportion to a difference between the threshold and the second threshold, so as to evaluate the area.

In this manner, the area of the absorbing portion can be evaluated by factoring in figures after decimal point in the threshold, thereby improving the evaluation precision of the discharge amount.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
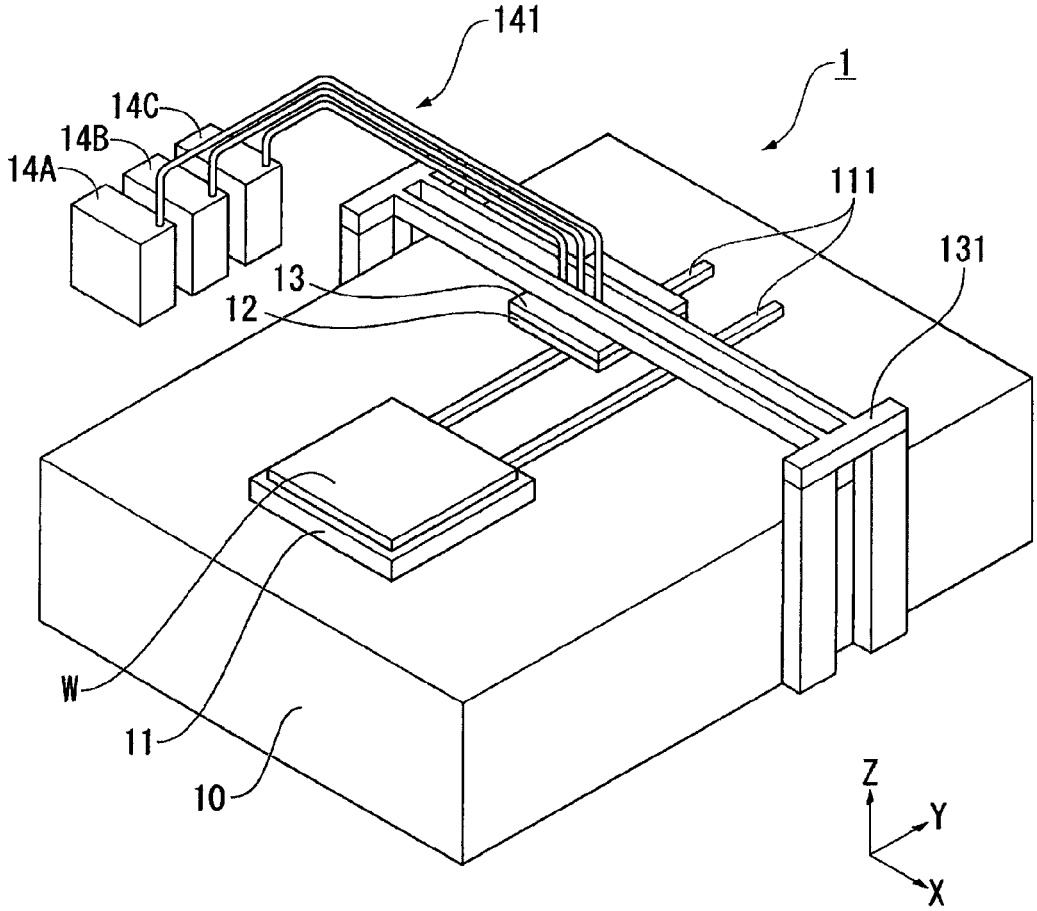
FIG. 1 is a schematic perspective view showing a structural example of a film forming apparatus including a liquid droplet discharging head.

Embodiments of the invention will be described, but it should be noted that a technological scope of the invention is not restricted to the embodiments below. In the following description, structural parts will be exemplified with reference to the drawings. For better understanding, structural characteristics will be simplified by making sizes and scales of the parts in the drawings different from actual ones. First, a structural example of a liquid droplet discharging device will be described, followed by a description of a discharge amount evaluation method of a liquid droplet discharging device according to an embodiment of the invention.

FIG. 1 is a schematic perspective view showing an example of a film forming apparatus including a liquid droplet discharging head (the liquid droplet discharging device). The film forming apparatus places a liquid on a workpiece (a substrate to be processed) by using a liquid droplet discharging method. The liquid placed includes a solid component such as a film forming material. The solid component remains when the liquid is dried. For example, the liquid may be a dispersion (a solution) prepared by dispersing (dissolving) the solid component in a dispersion medium (a solvent). As specific examples of the liquid, there may be mentioned color filter materials containing pigments or dyes, UV inks, colloidal solutions containing metal particles as materials for conductive patterns such as metal wires.

As shown in FIG. 1, a film forming apparatus 1 includes a work stage 11 provided on a support base 10 and a liquid droplet discharging head 12 provided in a higher position than the work stage 11. A workpiece W can be mounted on an upper surface of the work stage 11. Positions of the work stage 11 and the liquid droplet discharging head 12 are controlled by a not-shown controller. The controller is adapted to also control discharging operation of the liquid droplet discharging head 12. In the film forming apparatus 1 thus structured, the liquid droplet discharging head 12 discharges the liquid on a predetermined region of the workpiece W while scanning over the workpiece W.

Next will be given of a description based on an XYZ orthogonal coordinate system shown in FIG. 1. In the XYZ orthogonal coordinate system, an X direction and a Y direction are in parallel to a planar direction of the work stage 11, and a Z direction is orthogonal to the planar direction thereof. Actually, an XY plane is set as a plane parallel to a horizontal plane and the Z direction is set as a vertical direction. Upon formation of a film, for example, after placing the liquid in a main scanning direction, a position of a sub scanning direction is adjusted, and again, the liquid is placed in the main scanning direction. In this case, the main scanning direction is equivalent to the Y direction in which the work stage 11 is moved and the sub scanning direction is equivalent to the X direction in which the liquid droplet discharging head 12 is moved.

The work stage 11 includes a vacuum adsorption device (not shown) to removably fix the workpiece W mounted thereon. The work stage 11 also includes a stage moving device 111. The stage moving device 111 has a bearing mechanism such as a ball screw or a linear guide to move the work stage 11 in the Y direction based on a control signal input from the controller. Thereby, the workpiece W mounted on the work stage 11 can be moved to a predetermined position in the Y direction.

The film forming apparatus 1 includes three liquid droplet discharging heads 12 corresponding to three kinds of color filter materials (red, green, and blue). The three liquid droplet discharging heads 12 are mounted on a carriage 13. The carriage 13 includes a carriage moving device 131. The carriage moving device 131 can move the carriage 13 in the X direction or rotate the carriage 13 around a Z axis based on a control signal input from the controller. Thereby, the liquid droplet discharging heads 12 can be moved to a predetermined direction.

Each of the three liquid droplet discharging heads 12 has many discharging units (which will be described below). Each of the discharging units discharges the liquid based on drawing data or a control signal from the controller. The respective three kinds of liquids as the three kinds of color filter materials are reserved in respective tanks 14A, 14B, and 14C. Each of the three kinds of liquids reserved is supplied to a corresponding one of the liquid droplet discharging heads 12 through each tube of a tube group 141 in accordance with the kind of the liquid.

Figure 2A:
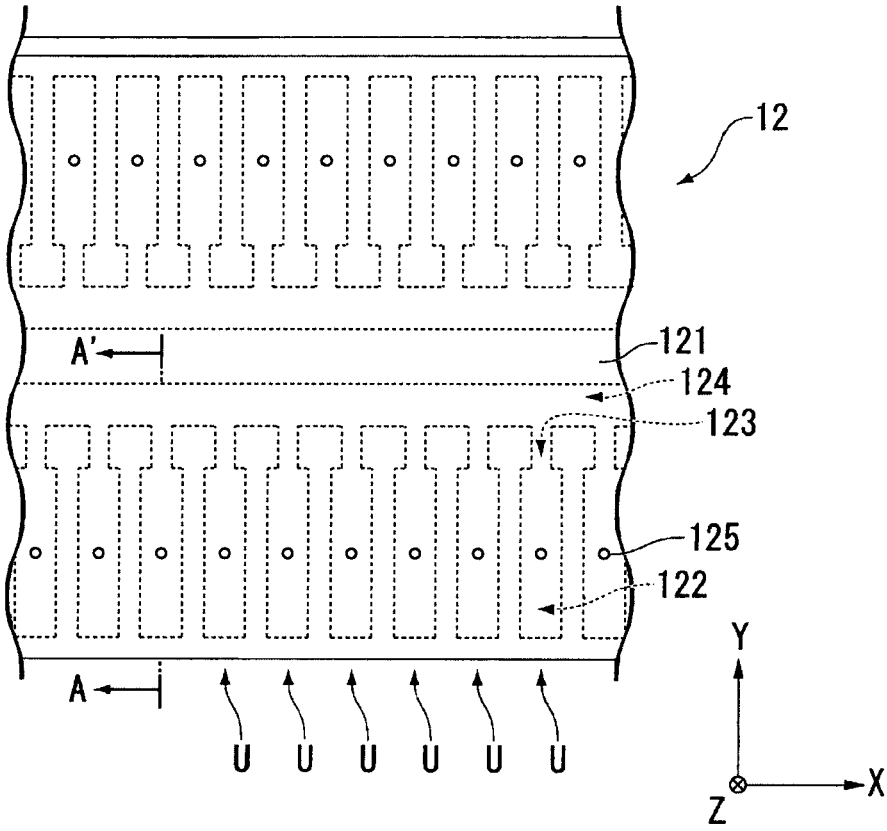
FIGS. 2A and 2B are a plan view and a sectional view of the liquid droplet discharging head.
Figure 2B:
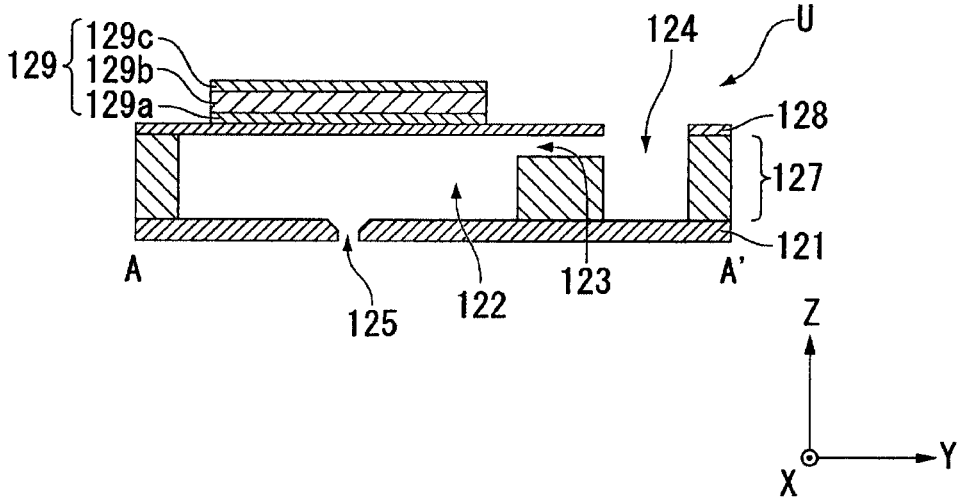

FIGS. 2A and 2B are schematic structural views of the liquid droplet discharging head 12. FIG. 2A is a plan view showing a surface of the discharging head 12 facing the workpiece W, and FIG. 2B is a sectional view taken along arrow lines A-A' of FIG. 2A.

As shown in FIG. 2A, the liquid droplet discharging head 12 includes a plurality of discharging units U placed approximately orthogonal to the main scanning direction (the Y direction). In the drawing, there are shown two discharging unit groups spaced apart from each other in the Y direction. Each of the two discharging unit groups includes the discharging units U (180 discharging units, for example) placed in the X direction. The discharging units U included in one of the two discharging unit groups are positioned between the discharging units U included in the other one of the discharging unit groups. There is provided a nozzle plate 121 common among the discharging units U. The nozzle plate 121 has a nozzle 125 for each of the discharging units U. The nozzles 125 are placed in the direction (the X direction) where the discharging units U are placed.

Each nozzle 125 is communicated with a liquid reserving chamber 122, which is communicated with a reservoir 124 common among the discharging units U through a liquid supply path 123. Although a detailed shape of the supply path 123 is not shown in the drawing, the supply path 123 is formed in a manner so as to prevent the liquid from flowing back to the reservoir 124 from the reserving chamber 122. The reservoir 124 is connected to any tube of the tube group 141 shown in FIG. 1. The liquid to be discharged from each discharging unit U is filled into the reserving chamber 122 through each tube of the tube group 141, the reservoir 124, and the supply path 123 from each of the tanks 14A, 14B, and 14C.

As shown in FIG. 2B, the each discharging unit U includes the nozzle plate 121, a vibrating plate 128, and a flow path-formed substrate 127 provided between the nozzle plate 121 and the vibrating plate 128. The flow path-formed substrate 127 has a through hole and a recessed portion. Sandwiching the through hole and the recessed portion by the nozzle plate 121 and the vibrating plate 128 allows formation of the liquid reserving chamber 122 and the liquid supply path 123. Accordingly, a part of the vibrating plate 128 forms a wall face of the reserving chamber 122.

In the each discharging unit U, a piezoelectric driving element 129 is provided on an opposite side of the vibrating plate 128 from the reserving chamber 122. The piezoelectric driving element 129 includes a lower electrode 129*a*, an upper electrode 129*c*, and a piezoelectric member 129*b* provided between the electrodes 129*a* and 129*c*. The controller supplies a drive voltage waveform to the piezoelectric driving element 129 of each of the discharging units U at a predetermined timing.

When the drive voltage waveform is supplied to the piezoelectric driving element 129, the piezoelectric member 129*b* is expanded and contracted in a planar direction. This allows a portion of the vibrating plate 128 two-dimensionally overlapping with the reserving chamber 122 to be displaced in a thickness direction orthogonal to the planar direction, whereby a capacity of the reserving chamber 122 is changed. When the capacity of the reserving chamber 122 becomes at minimum, an amount of the liquid equivalent to an amount of reduced capacity is pushed out from the nozzle 125 to be discharged on the workpiece W. The amount of the liquid discharged is based on the amount of capacity change in the reserving chamber 122 and can be adjusted by an amount of the displacement in the piezoelectric member 129*b*, namely, a level of a voltage applied between the lower and the upper electrodes 129*a* and 129*c*.

In order to adjust the discharge amount, for example, there may be mentioned an individual-adjustment method for each discharging unit U and a group-based adjustment method for the discharging units U separated into a plurality of groups. In the group-based adjustment of the discharge amount, each discharging unit U does not require a driving circuit such as a drive signal generating circuit. This can lead to cost reduction and miniaturization of the discharging device.

In addition, when performing a plurality of times of discharging operation on a predetermined region of the workpiece W, a total amount of the liquid placed on the predetermined region can be adjusted by adjusting the number of times of discharging operation or by using a combination of discharging units discharging relatively large and relatively small amounts of the liquid as discharging units U performing the discharging operation on the predetermined region.

Figure 3:
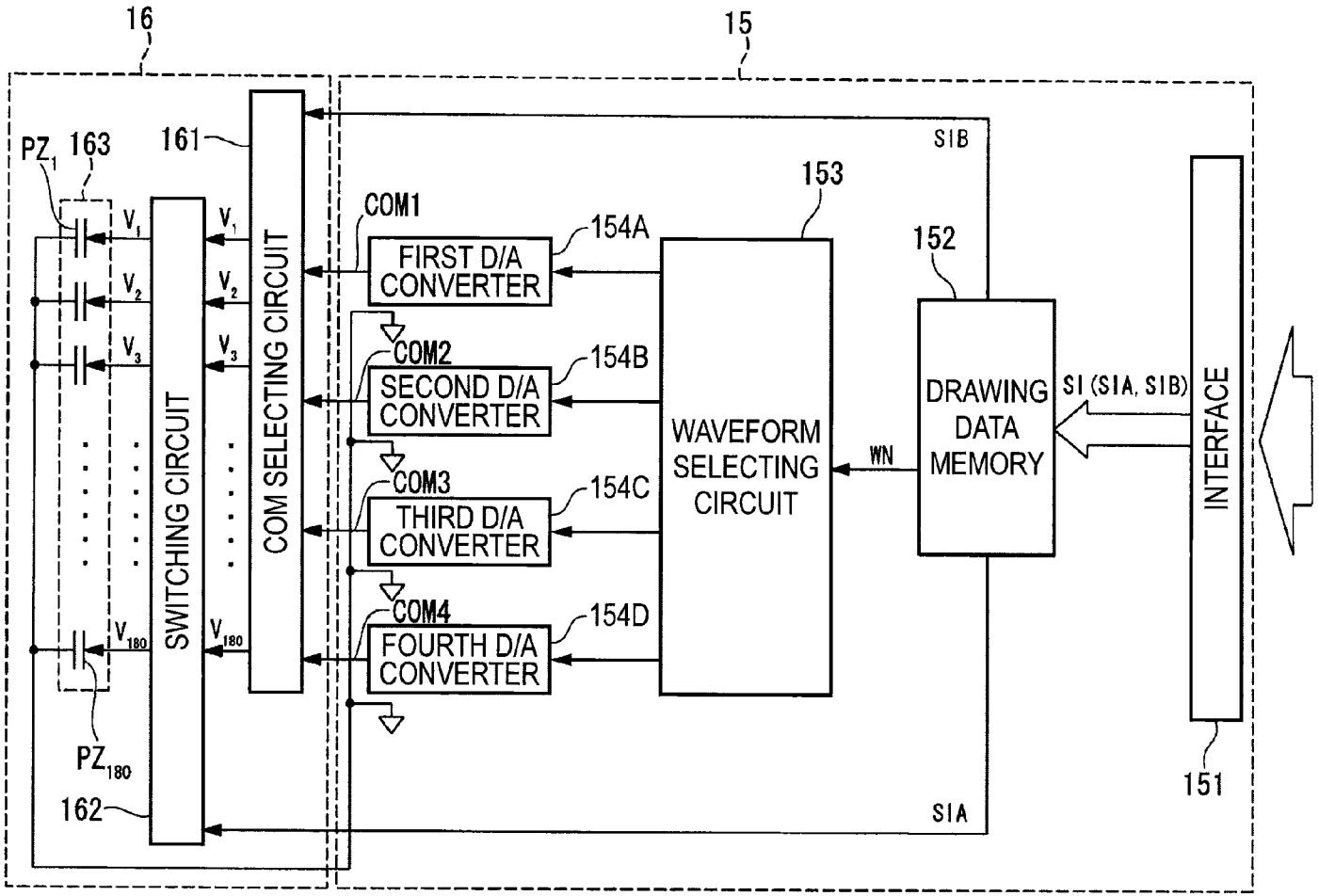
FIG. 3 is a schematic diagram showing a circuit structure of a control system.

FIG. 3 is a schematic diagram showing a circuit structure of a control system. The control system shown in the drawing includes a driving circuit substrate 15 and a driver 16. The driver 16 is included in the liquid droplet discharging head 12. The driving circuit substrate 15 is electrically connected to the driver 16 and also electrically connected to the controller of the film forming apparatus 1.

As shown in FIG. 3, the driving circuit substrate 15 includes an interface 151, a drawing data memory 152, a waveform selecting circuit 153, and first to fourth D/A converters 154A to 154D. The driver 16 includes a COM selecting circuit 161, a switching circuit 162, and a piezoelectric-member group 163 including piezoelectric members $PZ_1$ to $PZ_{180}$. Each of the piezoelectric members $PZ_1$ to $PZ_{180}$ corresponds to the piezoelectric member 129*b* shown in FIG. 2B. Among discharging units $U_1$ to $U_{180}$, discharging units to be used are divided into four groups, each of which receives a common drive signal.

The interface 151 is connected to the controller via a PCI bus (not shown) or the like. The controller outputs drawing data SI including discharge data SIA and COM selection data SIB and control signals such as clock signals and latch signals for driving and controlling circuits. The drawing data SI and the control signals are written into the drawing data memory 152. The drawing data memory 152 may be a 32-bit static random access memory (SRAM), for example.

The discharge data SIA is data determining whether a drive signal should be supplied to each of the discharging units $U_1$ to $U_{180}$ or not, in accordance with a relative position between the workpiece W and the liquid droplet discharging head 12. For example, the discharge data SIA may be bitmap data in which a thin film pattern formed is partitioned in a matrix and on/off of discharging operation in each bit of the partitioned pattern is mapped as binary data.

The COM selection data SIB is data determining grouping of the discharging units and determining a drive signal to be supplied to each unit group. In the embodiment, one of four kinds of drive signals COM1 to COM4 is selected as the drive signal for each discharging unit. The COM selection data SIB includes drive waveform number data WN determining waveforms of the drive signals COM1 to COM4 and data determining which of the drive signals COM 1 to COM4 should be selected for each of the discharging units. Thereby, a gathering of the discharging units driven by each of the drive signals is determined as a single group of the units.

In response to a data read-out request by each control signal, the drawing data memory 152 outputs the discharge data SIA as serial data to the switching circuit 162 of the driver 16 and outputs the COM selection data SIB as serial data to the COM selecting circuit 161 of the driver 16. The drive waveform number data WN is output to the waveform selecting circuit 153.

The waveform selecting circuit 153 reads out waveform data designated by the drive waveform number data WN from prestored waveform data (64 kinds of data, for example) to store the read-out data in an address corresponding to the discharge data SIA. Additionally, in response to a data read-out request by each control signal, the waveform selecting circuit 153 outputs drive waveform data stored in a designated address to each of the D/A converters.

The first D/A converter 154A retains the drive waveform data input from the waveform selecting circuit 153 in synchronization with each control signal. Additionally, the converter 154A converts the drive waveform data into an analog signal to generate the drive signal COM1, which is output to the COM selecting circuit 161 of the driver 16. Similarly, the second D/A converter 154B generates the drive signal COM2, the third D/A converter 154C generates the drive signal COM3, and the fourth D/A converter 154D generates the drive signal COM4, respectively, and those drive signals COM2 to COM4, respectively, are output to the COM selecting circuit 161.

The COM selecting circuit 161 is controlled by each control signal to output each of drive signals $V_1$ to $V_{180}$ for the piezoelectric element in each discharging unit to the switching circuit 162 based on the COM selection data SIB. In addition, the switching circuit 162 is controlled by each control signal to turn on/off each of the drive signals $V_1$ to $V_{180}$ for each discharging unit based on the discharge data SIA. Thereby, predetermined drive signals are supplied to predetermined piezoelectric members among the piezoelectric members $PZ_1$ to $PZ_{180}$ provided corresponding to the respective discharging units. The piezoelectric members receiving the drive signals are contracted by an amount of displacement in accordance with the level of the voltage applied between the lower and the upper electrodes 129*a* and 129*c*, thereby resulting in discharging of an amount of the liquid equivalent to the displacement amount.

Next, based on the film forming apparatus 1 thus formed, a description will be given of the discharge amount evaluation method of a liquid droplet discharging device according to the embodiment.

Figure 4A:
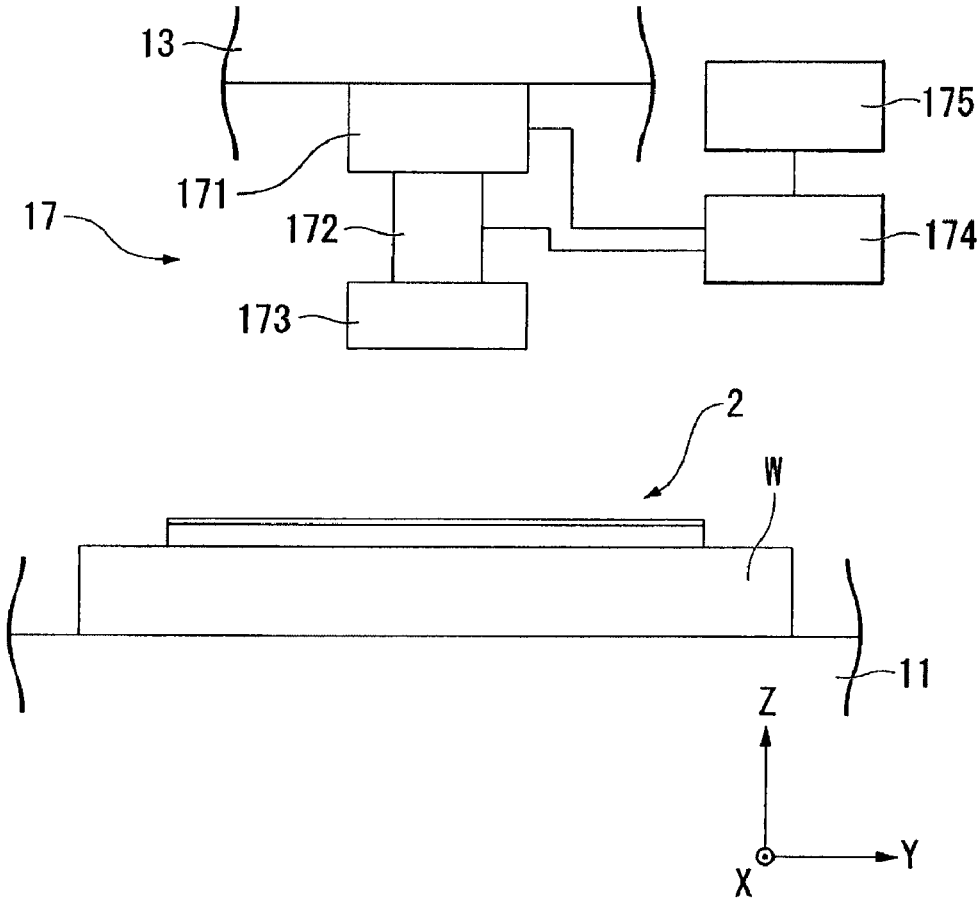
FIG. 4A is a structural view of an evaluating device and a test piece.
Figure 4B:
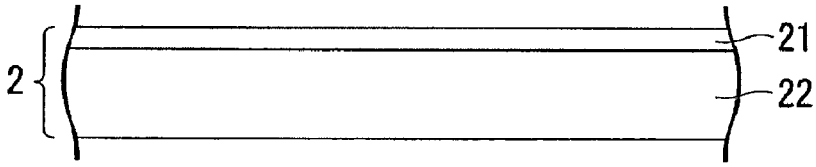
FIG. 4B is an enlarged view of the test piece.

FIG. 4A is a schematic view showing a structure of an evaluating device 17 and a test piece 2 used for discharge amount evaluation in the embodiment. FIG. 4B is an enlarged view of the test piece 2.

As shown in FIG. 4A, in the embodiment, the discharge amount is evaluated using the test piece 2 and the evaluating device 17. The evaluating device 17 is mounted on the carriage 13 of the film forming apparatus 1, and the test piece 2 is fixed on the workpiece W that is removably fixed to the work stage 11.

The evaluating device 17 includes an image pickup section (a CCD camera) 171, an optical system 172, an illumination section 173, a control section 174, and a memory section 175. Part of illumination light output from the illumination section 173 is reflected on a surface of an image pickup subject (which will be described later) placed on the test piece 2 to be transmitted through the optical system 172 into the CCD camera 171.

The CCD camera 171 includes a light receiving element converting received light into electric charge and an electric charge coupling element reading out the electric charge. The optical system 172 includes a single or a plurality of lens groups. An image picked up by the CCD camera 171 is enlarged, for example, to a size of approximately 6 to 10 times that of the image pickup subject by the optical system 172. The illumination section 173 includes ring illumination circularly surrounding an optical axis between the image pickup subject and the CCD camera 171.

The control section 174 controls on/off of the CCD camera 171 and also controls a focal distance and a diaphragm of the optical system 172. Additionally, the control section 174 analyzes an image pickup result of the CCD camera 171. Specifically, the control section 174 receives, as an electric signal, the electric charge read out by the electric charge coupling element to store the electric signal as image data in the memory section 175. The control section 174 also reads out and analyzes the image data stored in the memory section 175 to store an analysis result in the memory unit 175.

As shown in FIG. 4B, the test piece 2 includes a receiving layer 21 and a base layer 22. The receiving layer 21 is abutted with the base layer 22 that is fixed to the workpiece W.

The receiving layer 21 is made of a material that absorbs at least a part of a liquid component included in the liquid discharged from the liquid droplet discharging head 12. The liquid component included in the liquid may be a solvent for dissolving a solid component and/or a dispersion medium for dispersing the solid component. For example, when the liquid used is a dispersion prepared by dispersing a solid component in a dispersion medium, the material of the receiving layer 21 is selected from materials absorbing the dispersion medium. When the liquid is a mixture of a dispersion prepared by dispersing a solid component in a dispersion medium and a solution prepared by dissolving, in a solvent, a solid component same as or different from the solid component of the dispersion, the material of the receiving layer 21 is selected from materials absorbing at least one of the dispersion medium and the solvent. The receiving layer 21 has an approximately even thickness that is determined appropriately in accordance with a discharge amount. For example, as the discharge amount is smaller, the thickness of the receiving layer 21 is made smaller to increase evaluation precision. In the embodiment, the discharge amount is approximately a few picoliter and the thickness of the receiving layer 21 is approximately 10 micrometers.

The base layer 22 is made of a material that does not absorb the absorbing component absorbed by the receiving layer 21 in the liquid discharged. In this case, the base layer 22 may be made of polyethylene terephthalate (PET) or the like. Preferably, the base layer 22 has a thickness enough to prevent the absorbing component absorbed by the receiving layer 21 from passing through the layer, as well as, preferably, the thickness of the base layer 22 is set so as to allow the base layer 22 to be stably fixed to the workpiece W. From the viewpoints, the base layer 22 of the embodiment has a thickness approximately from a few hundred micrometers to a few millimeters (120 micrometers in the present example). Consequently, after mounting the evaluating device 17 and the test piece 2 on the film forming apparatus 1, evaluation will be performed through a following process.

Figure 5A:
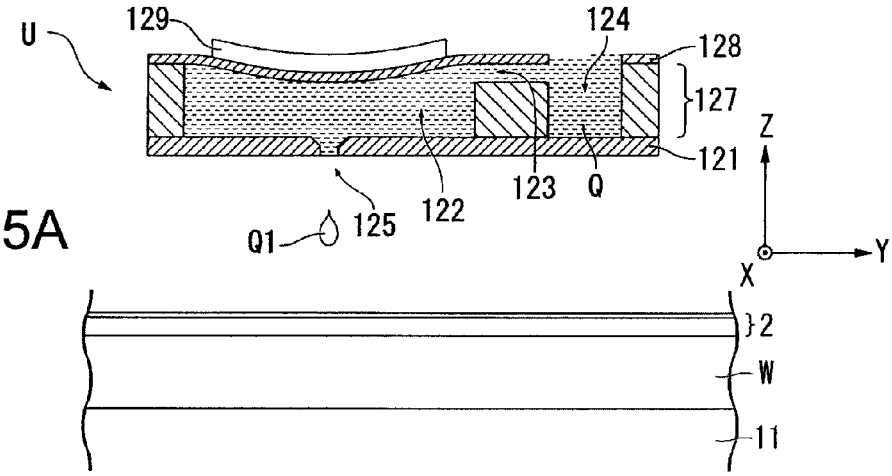
FIGS. 5A to 5C are step views showing a discharge amount evaluation method.
Figure 5B:
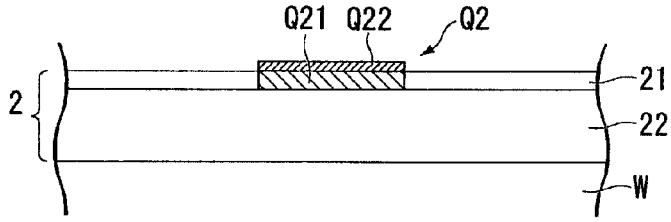
Figure 5C:
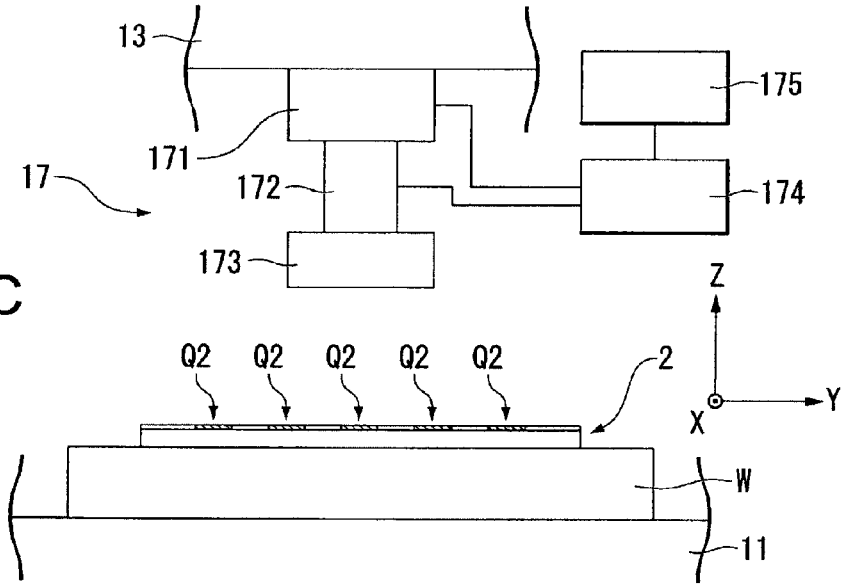

FIGS. 5A to 5C are step views showing the discharge amount evaluation method of the embodiment.

First, as shown in FIG. 5A, each discharging unit U of the liquid droplet discharging head 12 discharges a liquid droplet Q1 on the test piece 2. The liquid droplet Q1 is part of a liquid Q reserved in the reservoir 124 and the reserving chamber 122. The liquid Q of the present embodiment is prepared by dispersing a solid component in a dispersion medium (the absorbing component absorbed by the receiving layer 21). The liquid droplet Q1 discharged on a predetermined region of the test piece 2 may be a single droplet or may include a plurality of droplets. In the drawing, a single droplet of the liquid is discharged on a single spot of the test piece 2, resulting that a plurality of droplets of the liquid are discharged on a plurality of spots thereof.

As shown in FIG. 5B, a liquid Q2 (the liquid droplet Q1) landed on the test piece 2 spreads in a planar direction of the test piece 2. In the embodiment, the receiving layer 21 is adapted to absorb the dispersion medium included in the liquid Q2 but adapted not to absorb the solid component included in the liquid Q2. Additionally, the base layer 22 is adapted not to absorb the dispersion medium. Consequently, the solid component remains on the receiving layer 22 to form a solid Q22. The dispersion medium absorbed by the receiving layer 21 is not absorbed by the base layer 22 and spreads in the receiving layer 21 in a planar direction orthogonal to a thickness direction of the receiving layer 21, thereby resulting in formation of an absorbing portion Q21 equivalent to a portion where the dispersion medium has been absorbed in the receiving layer 21. The absorbing portion Q21 has a thickness approximately equal to the thickness of the receiving layer 21.

Next, as shown in FIG. 5C, while retaining the test piece 2 on the work stage 11, the carriage 13 is moved to locate the evaluating device 17 in a position where an image of the liquid Q2 placed on the test piece 2 can be picked up. The film forming apparatus 1 stores positional information and the like of the liquid droplet discharging head 12 located when discharging the liquid droplet Q1. Based on the positional information, a relative positional adjustment between the placed liquid Q2 and the evaluating device 17 can be achieved. Since the test piece 2 is not removed from the film forming apparatus 1, relative positions of the placed liquid Q2 and the evaluating device 17 can be easily adjusted with high precision.

The control section 174 of the evaluating device 17 allows the optical system 172 to perform focus adjustment or the like, as well as allows the CCD camera 171 to pick up an image of the placed liquid Q2 (an image pickup subject). Since the relative positions of the liquid Q2 and the evaluating device 17 are adjusted with high precision, the focus adjustment or the like can be easily performed with high precision, thereby enabling the resulting image to have high quality. An image pickup range of the camera may include only a single droplet of the liquid Q2 or a plurality of droplets of the liquid Q2. In the present embodiment, the CCD camera 171 picks up the image of the range including the plural droplets of the liquid Q2. The image thus obtained will be analyzed through analyzing processing as below to evaluate the discharge amount.

Figure 6A:
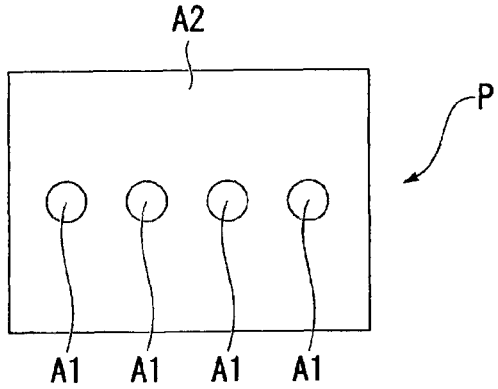
FIG. 6A is a schematic view of an image example.
Figure 6B:
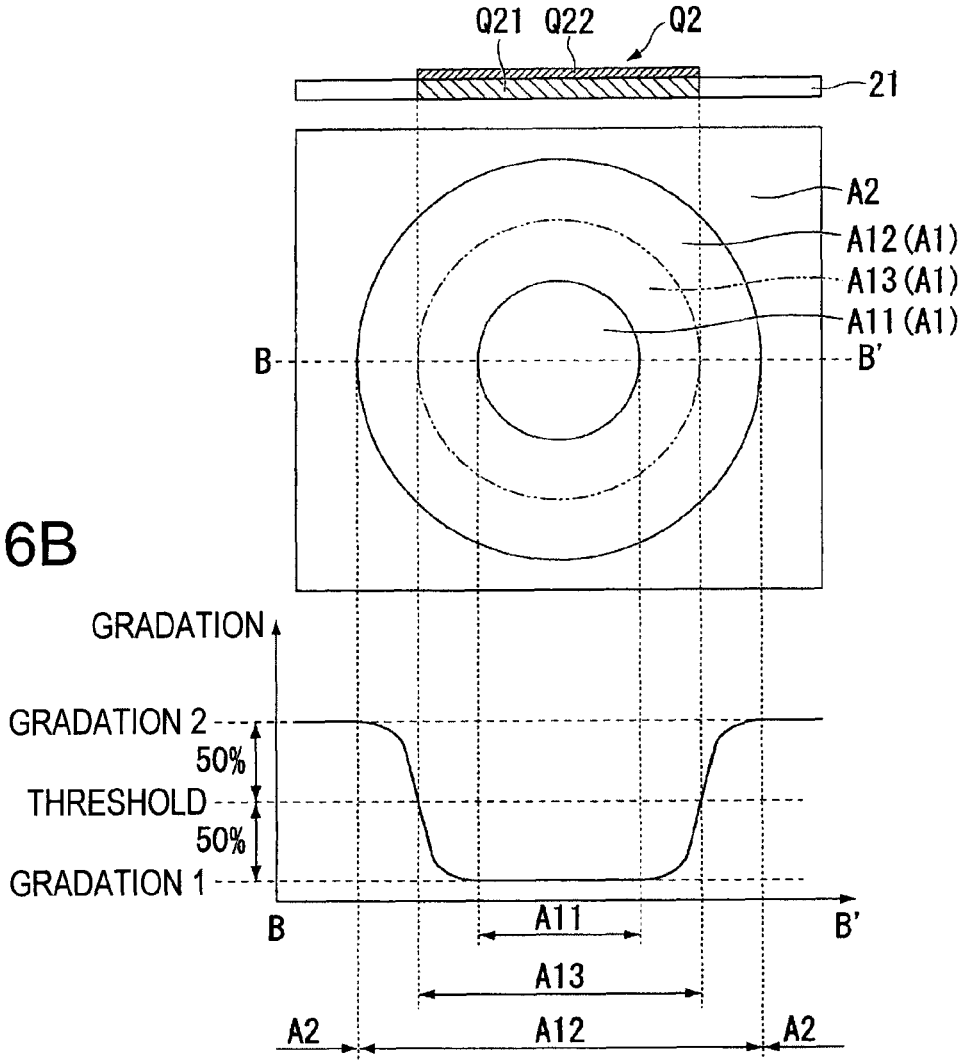
FIG. 6B is an illustrative view of an analyzing method.

FIG. 6A is a schematic plan view showing an example of the obtained image, and FIG. 6B is an illustrative view showing an analyzing method in the analysis processing. FIG. 6B correspondingly shows a side view of the liquid Q2 placed on the test piece 2, an enlarged view of an evaluation region A1 in an image P corresponding to the placed liquid Q2, and a gradation distribution graph along line B-B' passing through a center of the evaluation region A1.

As shown in FIG. 6A, the image P picked up by the CCD camera 171 includes the evaluation region A1 corresponding to the absorbing portion Q21 and a peripheral region A2 around the absorbing portion Q21 corresponding to the receiving layer 21. The evaluation region A1 is a roughly round region and the image P includes a plurality of evaluation regions A1 corresponding to the plural droplets of the liquid Q2.

As shown in the enlarge view of the evaluation region A1 and the gradation distribution graph of FIG. 6B, gradation is approximately constant both in a center region A11 of the evaluation region A1 and the peripheral region A2. In the embodiment, the gradation of the evaluation region A1 is lower than the gradation of the peripheral region A2. In a region between the center region A11 and the peripheral region A2, gradation consecutively becomes higher as it becomes farther from the center region A11. In the drawings for the description of the embodiment, the region between the center region A11 and the peripheral region A2 are exaggeratingly shown.

An actual outline of the absorbing portion Q21 is included in the region in which the gradation consecutively changes between the center region A11 and the peripheral region A2. In the region, an optical image of the absorbing portion Q21 becomes blurred due to defocus, aberration or vignetting in the lens of the optical system 172, light scattering near the outline of the absorbing portion Q21, or the like. The region can be reduced by focus adjustment. Meanwhile, it is difficult to completely eliminate aberration and vignetting, and the optical system 172 may have a complicated structure, thus leading to an increase in device cost. Complete elimination of influence of scattered light is almost impossible in the image pickup method obtaining an image by light reflected on the surface of the image pickup subject, so that the region having the changing gradation cannot be completely eliminated. It is usually extremely difficult to directly and accurately obtain the actual outline of the absorbing portion Q21. Picking up an image of a plurality of absorbing portions Q21 all together allows efficient evaluation of the discharge amount. However, in that case, multipoint focusing and the like cannot be easily performed, which normally would deteriorate evaluation precision.

The method of the embodiment uses a method described below, whereby efficient evaluation can be achieved while ensuring evaluation precision.

Hereinafter, between the central region A11 and the peripheral region A2, a region surrounded by the actual outline of the absorbing portion Q21 is referred to as a rim region A13. A region between the rim region A13 and the peripheral region A2 is referred to as an adjacent region A12. The rim region A13 corresponds to a rim of the absorbing portion Q21, and the adjacent region A12 corresponds to a portion located outside and adjacent to the actual absorbing portion Q21.

In the embodiment, a threshold is set by using the gradation of the absorbing portion Q21 and the gradation of the peripheral portion, and the rim region A13 is determined by using the threshold to obtain the actual outline of the absorbing portion Q21. In this case, in the evaluation region A1 corresponding to the absorbing portion Q21, a gradation of a region except for the rim region A13 where the gradation changes and the adjacent region A12, namely, the gradation of the central region A11 corresponds to a gradation of the absorbing portion Q21. The gradation of the peripheral region A2 corresponds to the gradation of the peripheral portion. The central region A11 and the peripheral region A2 may be determined by using any of statistical methods.

For example, there may be mentioned a method in which after cutting off a region around a center of the evaluation region A1, a portion of the cut-off region having a gradation change rate equal to or less than a predetermined value (which may be a level of measurement error) is set as the central region A11. For example, the gradation change rate can be evaluated by using a gradation difference between adjacent pixels or by obtaining an approximate expression of gradation distribution to use a differential constant of the approximate expression for each pixel, or the like. Similarly, the peripheral region A2 can be determined by the same manner as in the central region A11.

Besides the above-described method, there may be mentioned another method in which, in the cut-off region around the center of the evaluation region A1, gradation variation is evaluated by standard deviation, root-mean-square (RMS), or the like, and a region having a gradation variation equal to or less than a predetermined value (approximately a level of measurement error, for example) is set as the central region A11.

The measurement error seems to be caused by illumination variation of illumination light or the like. For example, the measurement error can be estimated by picking up an image before arranging the absorbing portion Q21 and then assuming that gradation variation in the image is due to the illumination variation of illumination light.

In the embodiment, as shown in the graph of FIG. 6B, a mean value between a gradation 1 of the center region A11 and a gradation 2 of the peripheral region A2 is set as a threshold. For example, the gradation 1 indicates a gradation mean value of the center region A11 and the gradation 2 indicates a gradation mean value of the peripheral region A2. In general, an outline of an object is blurred symmetrically inside and outside the outline. Thus, the outline of the absorbing portion Q21 can be determined by determining a region having a gradation coincident with the mean value between the gradations 1 and 2 (the threshold).

For example, by obtaining a number of pixels having a gradation equal to or less than the threshold, there is obtained an amount corresponding to an area of the region surrounded by the outline. In order to determine whether the pixels are included in the region surrounded by the outline or not, there may be used a method for obtaining a number of pixels having a gradation less than the threshold, a method for obtaining a mean value between the number of the pixels having the gradation equal to or less than the threshold and the number of the pixels having the gradation less than the threshold, or the like. In this case, the number of the pixels is equivalent to an index representing the area and may be an integer, a fraction, or a decimal.

In addition, evaluation precision can be increased by a following method using interpolation. As numerical examples, the gradations 1 and 2, respectively, are assumed to be 30 and 100.6, respectively. A mean value 65.3 between the gradations 1 and 2 is set as a threshold. An integer 66 obtained by rounding up one figure after decimal point in the threshold is set as a first threshold. Thereby, there is obtained the number of pixels having a gradation equal to or less than the first threshold (a first temporary evaluation). The number of the pixels obtained is referred to as S66. Next, an integer 65 obtained by rounding down the one figure after decimal point in the threshold is set as a second threshold to thereby obtain the number of pixels with a gradation equal to or less than the second threshold (a second temporary evaluation). The number of the pixels obtained is referred to as S65.

Next, S66 is weighted in inverse proportion to 0.7 as a difference between the first threshold and the threshold, and S65 is weighted in inverse proportion to 0.3 as a difference between the second threshold and the threshold. Specifically, based on an interpolation method, the number of pixels S corresponding to the threshold is obtained by interpolating using an expression ($S=0.3\times S66+0.7\times S65$). By using the method, figures after decimal point in the threshold can be factored in, so that the amount corresponding to the area of the region surrounded by the outline can be obtained with high precision. Also as this method, there can be used the method for determining the pixels included in the region surrounded by the outline.

In addition, using a following numerical analyzing method, the area inside the outline can also be evaluated. In this method, first, there is obtained an approximate expression of a curve of gradation distribution along a line selected according to need. Then, a solution of the approximate expression corresponding to the threshold is calculated to obtain coordinates of points on the outline of the image P. The above line is moved in a direction orthogonal to the line to consecutively obtain the coordinates of the points on the outline. Next, a closed curve passing through the obtained points is set as the outline, and an area or the number of pixels inside the outline is obtained by integration or the like.

Alternatively, in the image pickup processing, a plurality of images may be picked up by changing a focus of a single absorbing portion Q21, and in the analyzing processing, the area of the absorbing portion Q21 may be evaluated. The analyzing processing using the images will be described below.

Figure 7:
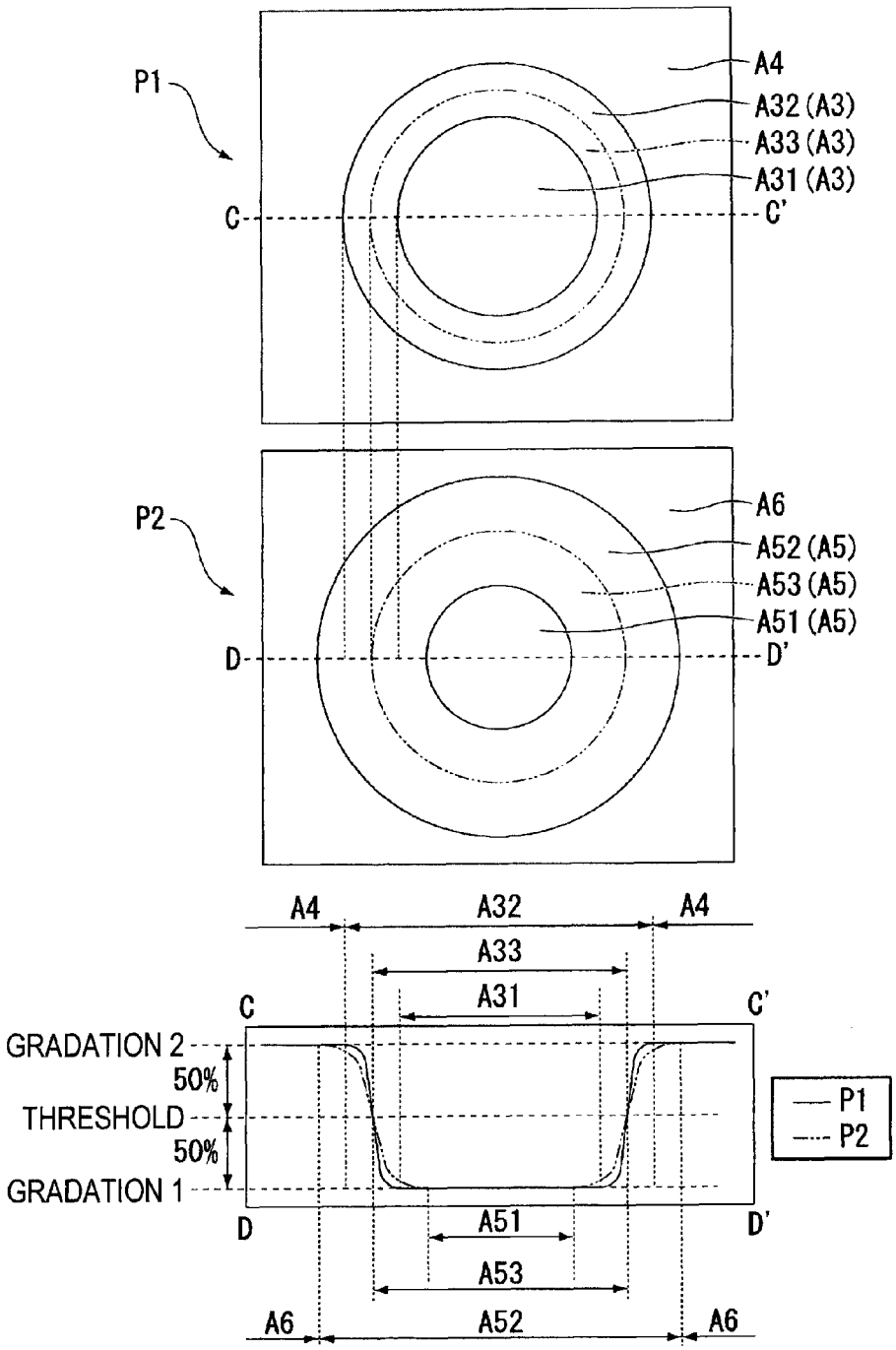
FIG. 7 is an illustrative view of an analyzing method different from the method of FIG. 6B.

FIG. 7 is an illustrative view showing analyzing processing different from that shown in FIGS. 6A and 6B. In FIG. 7, enlarged views of images P1 and P2 picked up by changing a focus correspond to a graph indicating a comparison of gradation distribution between the images P1 and P2. The image P1 is in sharper focus than the image P2.

As an example of the analyzing processing method using a plurality of images, the area of the absorbing portion Q21 is evaluated by using a threshold set based on the images or by obtaining the outline of the absorbing portion Q21 using a numerical analysis approach based on the images. Those methods will be described below.

As shown in the enlarged view of the image P1 of FIG. 7, the image P1 includes an evaluation region A3 and a peripheral region A4. The evaluation region A3 includes a center region A31, a rim region A33, and an adjacent region A32. Additionally, the enlarged view of the image P2 of FIG. 7 shows the image P2 including an evaluation region A5 and a peripheral region A6. The evaluation region A5 includes a center region A51, a rim region A53, and an adjacent region A52. The regions are defined in the same manner as in the image P of FIGS. 6A and 6B.

In a comparison between the images P1 and P2, in the image P1 in focus, the center region A31 is larger than the center region A51 of the image P2, whereas the adjacent region A32 is smaller than the adjacent region A52 of the image P2. When the gradation distribution is compared between the images P1 and P2, the graph of FIG. 7 shows that a gradation distribution curve of the image P1 intersects with a gradation distribution curve of the image P2. An optical image seems to be blurred symmetrically with respect to a portion near the actual outline of the absorbing portion Q21, inside and outside the outline. Thus, an intersection between the two curves seems to be corresponding to a position of the actual outline of the absorbing portion Q21. Consequently, by setting a gradation at the intersection between the two curves as a threshold, the actual outline of the absorbing portion Q21 can be obtained with high precision.

Often, the gradation at an intersection between two curves is approximately equivalent to the mean value between the gradations 1 and 2. Accordingly, as in the analyzing processing of FIGS. 6A and 6B, using the mean value between the gradations 1 and 2 as the threshold can simplify setting of threshold, as well as allows setting of an appropriate threshold regardless of defocus or the like.

Furthermore, instead of setting the gradation at the intersection between the two curves as the threshold, approximate expressions of the gradation distribution curves may be obtained to obtain an intersection between the two curves, whereby the coordinates of points located on the outline of the absorbing portion Q21 on the image can be obtained. A curve indicating the outline of the absorbing portion Q21 is gained by obtaining many points as above and then a curve passing through the obtained points. Consequently, the area of the region surrounded by the outline can be calculated and evaluated.

By using any of the various methods described above, there can be obtained the amount (the number of pixels) in proportion to the area of the absorbing portion Q21, thereby allowing evaluation of the area thereof. Additionally, for example, the area of the absorbing portion Q21 can be obtained also by picking up an image of an object whose size is known and finding a correlation between a pixel size and an actual object size. Furthermore, a volume of the absorbing portion Q21 can be obtained by multiplying the area of the absorbing portion Q21 and the thickness thereof, namely, the thickness of the receiving layer 21. The composition of the absorbing portion Q21 is known, so that a volume of the liquid Q1 can be obtained from the volume of the absorbing portion Q21, and the discharge amount of the liquid droplet discharging device can also be obtained.

The number of pixels corresponding to the absorbing portion Q21, the area and the volume of the absorbing portion Q21 are all in proportion to the discharge amount. Accordingly, any of the above amounts can be used to perform a relative evaluation of the discharge amount. For example, for each of the discharging units U, after obtaining the number of pixels corresponding to the absorbing portion Q21, there is calculated a mean value of the number of pixels among the discharging units U. Then, based on the mean value, the numbers of pixels corresponding to the discharging units U are standardized, which can allow evaluation of a relative discharge amount among the discharging units U. The relative discharge amount can be used to adjust conditions such as a drive voltage waveform and a number of times of discharging in discharging units whose discharge amount is different from the mean value, thereby achieving equalization of the discharge amount among the discharging units U. An example of a discharge amount equalizing method will be described below.

Figure 8A:
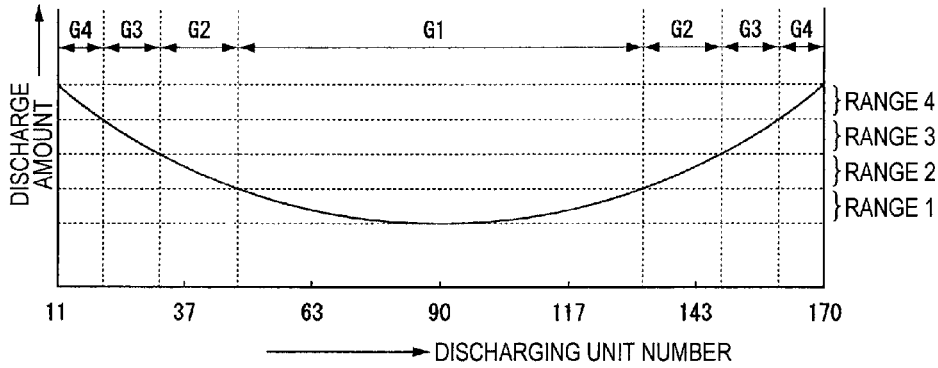
FIGS. 8A to 8C are illustrative views showing an example of a discharge amount equalizing method.
Figure 8B:
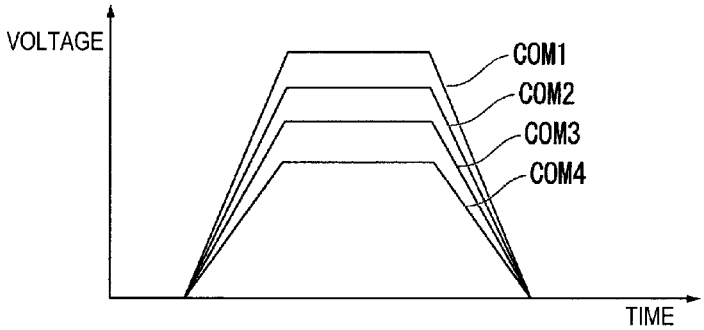
Figure 8C:
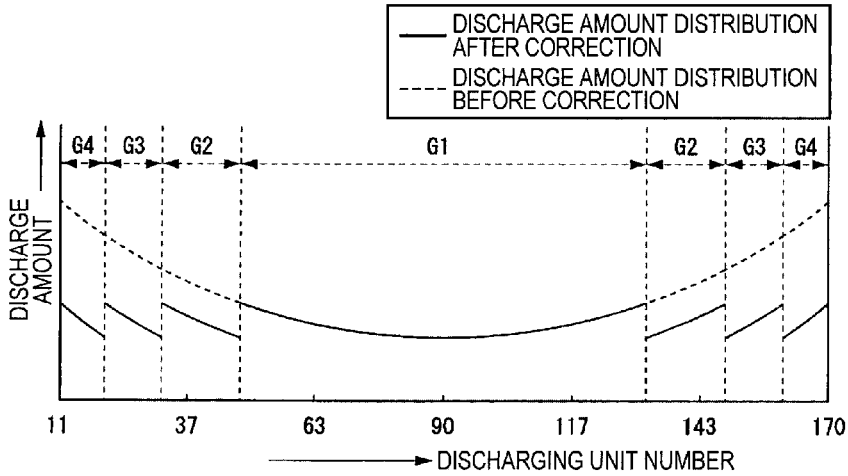

FIGS. 8A to 8C are illustrative views showing the an example of the discharge amount equalizing method. FIG. 8A is a graph showing an example of discharge amount distribution in a plurality of discharging units of a single liquid droplet discharging head. FIG. 8B is a graph showing an example of a drive voltage waveform, and FIG. 8C is a graph comparing discharge amount distributions before and after discharge amount correction.

In FIGS. 8A and 8C, a horizontal axis indicates discharging unit numbers and a longitudinal axis indicates discharge amounts. The liquid droplet discharging head described by referring to the drawings includes 180 pieces of the discharging units $U_1$ to $U_{180}$ placed in a single line. In assignment of the discharging unit numbers, the units are numbered consecutively from one end of the line to the other. The discharge amount of each discharging unit is based on data obtained by the above-described evaluation method. In the present example, regarding the number of pixels placed inside the outline of the absorbing portion Q21 in the image corresponding to the absorbing portion Q21, there is obtained a mean value among the discharging units and then, the mean value is used to standardize the number of pixels corresponding to each discharging unit. The discharge amounts of the discharging units, which are discrete data, are shown by connecting with a smooth line in FIGS. 8A and 8C.

As shown in FIG. 8A, the discharge amounts are larger in the discharging units closer to opposite ends of the line, so that the discharge amount distribution shows a U-letter shape. Depending on a liquid droplet discharging head, there may be shown a W-shaped discharge amount distribution result. Although not shown in FIG. 8A, among the discharging units $U_1$ to $U_{180}$ linearly placed, discharging units positioned on opposite-end sides of the line discharge much larger amounts than discharging units on a centerward side. Accordingly, in the example, discharging units $U_1$ to $U_{10}$ and $U_{171}$ to $U_{180}$ on the opposite-end sides will not be used from the standpoint of equalizing the discharge amounts.

In order to equalize the discharge amounts of the discharging units $U_{11}$ to $U_{170}$, first, a range from a minimum value to a maximum value in the discharge amounts is divided into four ranges, for example, in a manner so as to equalize widths of the discharge amounts in each range or equalize the number of discharging units included in the each range. In the example, after dividing the range into the four ranges so as to equalize the widths of the discharge amounts, there are set ranges 1 to 4, consecutively from smaller to larger value ranges.

Next, discharging units corresponding to discharge amounts included in the range 1 are referred to as a group G1, and discharging units corresponding to discharge amounts included in the range 2 are referred to as a group G2. Then, Groups 3 and 4 are formed in the same manner, resulting that the discharging units $U_{11}$ to $U_{170}$ are divided into the groups G1 to G4. Next, the drive signals COM1 to COM4 (See FIG. 3), respectively, are set for the groups G1 to G4, respectively. For example, the drive signals COM1 to COM4 have waveforms as shown in FIG. 8B.

In the embodiment, based on a relational expression of the discharge amount with respect to a voltage applied to the piezoelectric element of each discharging unit, there is calculated a voltage for a predetermined discharge amount (a correction drive voltage). The correction drive voltage is obtained by a following expression (1), for example. In the expression (1), a statistical value: "a center weight in a range" may be replaced by a statistical value: "a mean weight of the discharging units in each group". For a unit group having larger discharge amounts (such as the group G4), there may be set a low voltage drive signal (such as the COM4), whereas, for a unit group having smaller discharge amounts (such as the group G1), there may be set a high voltage drive signal (such as the COM1), for example. This can achieve equalization of the discharge amounts.

$$\text{Correction drive voltage} = V0 - K \times (\text{a center weight in a range} - \text{an appropriate weight}) \quad (1)$$

FIG. 8C is a graph comparing discharge amount distribution (before correction) by a predetermined drive signal and discharge amount distribution (after correction) by the drive signals COM1 to COM4. As in FIG. 8C, as compared to the distribution before correction, after correction, discharge amount variation in the entire liquid droplet discharging head is significantly reduced. When forming a color filer by using the liquid droplet discharging head subjected to the discharge amount correction, the color filter can obtain an even thickness. This can prevent streaked unevenness or the like associated with film thickness variation.

In the discharge amount evaluation method of a liquid droplet discharging device as described above, the discharge amount is evaluated by the area of the absorbing portion spread in the receiving layer, so that the evaluation can be performed by two-dimensional measurement. Thus, as compared to shape measurement by three-dimensional measurement, measurement can be more easily performed, thereby achieving efficient discharge amount evaluation.

The area of the absorbing portion is evaluated using the picked-up image of the absorbing portion, without influences of defocus, the optical system, and the like. Thus, the discharge amount evaluation can be performed with high precision. In addition, the threshold for each absorbing portion is set to evaluate the area by the threshold. This can eliminate the influence of illumination variation of illumination light, thus achieving high-precision evaluation of the discharge amount.

In addition, since drying of the discharged liquid is unnecessary, drying time can be omitted, as well as reduction in evaluation precision caused by drying of the liquid is avoidable. Consequently, the discharge amount can be evaluated with high precision and high efficiency.

As described above, the method of the embodiment can achieve high-precision evaluation of the amounts of the liquid discharged from the discharging units in the liquid droplet discharging device, thereby equalizing the discharge amounts among the discharging units. Upon production of a liquid droplet discharging device, forming a plurality of discharging units so as to equalize characteristics of the discharging units requires highly advanced processing technologies, leading to an increase in production cost and yield reduction in the liquid droplet discharging device. However, by performing the above-described discharge amount correction, even the liquid droplet discharging device that may have permissible errors to some extent in production can discharge a significantly equalized amount of liquid at low cost.

Discharge amount variation among the discharging units is caused also by locations, duties (operation rates), and the like of the discharging units. Accordingly, the discharge amount varies even among discharging units having equal characteristics. In order also to reduce the discharge amount variation in that case, it is quite effective to perform the discharge amount correction in software, such as a control method.

In the example described in the embodiment, the liquid used is the dispersion prepared by dispersing the solid component in the dispersion medium. However, the liquid may be a solution prepared by dissolving a solid component in a solvent or a mixture liquid of a dispersion containing a solid component dispersed in a dispersion medium and a solution prepared by dissolving, in a solvent, a solid component same as or different from the solid component of the dispersion medium. Even with any of the above liquids, the method of the embodiment can achieve discharge amount evaluation with high precision and high efficiency.

Furthermore, the receiving layer only needs to absorb at least one of the solvent and the dispersion medium as the component included in the liquid. For example, the mixture liquid of a solution and a dispersion may be used as the liquid, where the receiving layer may absorb the solvent and may not absorb the dispersion medium. In this case, it is only necessary to evaluate the area of an absorbing portion where the solvent has been absorbed in the receiving layer. For example, if an image of the absorbing portion can be picked up by light transmitted through the dispersion medium spread on the receiving layer, the image can be used for evaluation of the area.

When the area of the absorbing portion cannot be evaluated by using the image picked up through the dispersion medium, the area of the absorbing portion may be increased such that an entire outline of the absorbing portion is located outside the dispersion medium when the dispersion medium spread on the receiving layer is two-dimensionally viewed. Specifically, as the receiving layer is thinner, the area of the absorbing portion is increased, so that it is only necessary to adjust the thickness of the receiving layer to such an extent that the area of the absorbing portion can be evaluated. In this case, to evaluate the area, the thickness of the receiving layer may be adjusted such that the absorbing portion protrudes with a sufficient margin from the dispersion medium to set a threshold using a gradation of the protruding portion or a plurality of images taken with different focuses may be used.

Still furthermore, a mean value of the discharge amount can be obtained by placing a plurality of droplets of the liquid on a predetermined region of the test piece by a plurality of times of discharging operation to divide a total amount of the placed liquid by a total number of the droplets.

The entire disclosure of Japanese Patent Application No. 2008-298095, filed Nov. 21, 2008 is expressly incorporated by reference herein.

What is claimed is:

1. A discharge amount evaluation method of a liquid droplet discharging device that is performed to evaluate a discharge amount of a liquid discharged by the liquid droplet discharging device, the liquid including at least one of a solution prepared by dissolving a solute in a solvent and a dispersion prepared by dispersing a dispersoid in a dispersion medium, the method comprising:

discharging the liquid by the liquid droplet discharging device on a receiving layer of a test piece, the test piece including the receiving layer that absorbs at least one of the solvent and the dispersion medium as components included in the liquid and a base layer that is abutted with the receiving layer and that does not absorb the at least one component absorbed by the receiving layer in the components included in the liquid; and evaluating the discharge amount of the liquid based on a result obtained by evaluating an area of an absorbing portion where the at least one absorbed component has spread in the receiving layer.

2. The discharge amount evaluation method of a liquid droplet discharging device according to claim 1, wherein, in the evaluation step, the area is evaluated by an image-pickup processing that picks up an image of the absorbing portion and an analyzing processing that analyzes the image.

3. The discharge amount evaluation method of a liquid droplet discharging device according to claim 2, wherein, in the analyzing processing, a threshold is set using a gradation of the absorbing portion in the image and a gradation of a peripheral region around the absorbing portion in the image to detect an outline of the absorbing portion based on the threshold so as to evaluate the area of the absorbing portion.

4. The discharge amount evaluation method of a liquid droplet discharging device according to claim 3, wherein, in the analyzing processing, the gradation of the absorbing portion is a gradation of a part except for a rim of the absorbing portion in the image, and the gradation of the peripheral region is a gradation of a part except for a region adjacent to the absorbing portion in the image.

5. The discharge amount evaluation method of a liquid droplet discharging device according to claim 3, wherein, in the analyzing processing, the gradation of the absorbing portion and the gradation of the peripheral region are obtained by excluding a gradation changing region in the image.

6. The discharge amount evaluation method of a liquid droplet discharging device according to claim 3, wherein, in the evaluation step, the image pickup processing is performed a plurality of times by changing a focal distance, and in the analyzing processing, the threshold is set using a plurality of images obtained by performing the image pickup processing the plurality of times.

7. The discharge amount evaluation method of a liquid droplet discharging device according to claim 3, wherein, in the analyzing processing, the threshold is a mean value between the gradation of the absorbing portion and the gradation of the peripheral region.

8. The discharge amount evaluation method of a liquid droplet discharging device according to claim 3, wherein, in the analyzing processing, a first temporary evaluation of the area is performed using a first threshold that is an integer obtained by rounding up figures after decimal point in the threshold and a second temporary evaluation of the area is performed using a second threshold that is an integer obtained by rounding down the figures after decimal point in the threshold, as well as a value evaluating the area in the first temporary evaluation is weighted in inverse proportion to a difference between the threshold and the first threshold and a value evaluating the area in the second temporary evaluation is weighted in inverse proportion to a difference between the threshold and the second threshold, so as to evaluate the area.

* * * * *